US006044813A

United States Patent [19]

Bulgatz et al.

[11] Patent Number: 6,044,813

[45] Date of Patent: Apr. 4, 2000

[54] ELECTROMAGNETIC ACTUATOR WITH DETACHED LOWER COLLAR TO ALIGN WITH CYLINDER HEAD BORE

[75] Inventors: Dennis Bulgatz, Williamsburg; Robert McFarland, Newport News, both of Va.

[73] Assignee: Siemens Automotive Corporation, Auburn Hills, Mich.

[21] Appl. No.: 09/175,265

[22] Filed: Oct. 20, 1998

Related U.S. Application Data

[60] Provisional application No. 60/069,144, Dec. 9, 1997.

[51] Int. Cl.[7] ..... F01L 9/04

[52] U.S. Cl. ..... 123/90.11; 123/90.12; 123/90.55; 29/888.43; 251/129.15

[58] Field of Search ..... 123/90.11, 90.12, 123/90.55; 251/129.15, 129.16, 129.2, 129.21, 129.22; 29/888.43

[56] References Cited

U.S. PATENT DOCUMENTS

| | | | |
|---|---|---|---|
| 850,738 | 4/1907 | Dempster | 123/90.11 |
| 4,682,574 | 7/1987 | Kreuter | 123/90.11 |
| 4,800,851 | 1/1989 | Hetrich et al. | 123/90.46 |
| 4,878,464 | 11/1989 | Richeson, Jr. et al. | 123/90.11 |
| 5,131,624 | 7/1992 | Krueter et al. | 251/129.18 |
| 5,327,856 | 7/1994 | Schroeder et al. | 123/90.11 |
| 5,779,220 | 7/1998 | Nehl et al. | 251/129.15 |
| 5,857,435 | 1/1999 | Yang | 123/65 VB |
| 5,878,704 | 3/1999 | Schebitz et al. | 123/90.11 |

FOREIGN PATENT DOCUMENTS

| | | | |
|---|---|---|---|
| 1391955 | 4/1975 | United Kingdom | 123/90.11 |

*Primary Examiner*—Tony M. Argenbright
*Assistant Examiner*—Brian Hairston

[57] ABSTRACT

An electromagnetic actuator is provided for mounting to a cylinder head of an engine. The actuator includes an actuator assembly including housing structure and an armature. A pair of electromagnets are disposed in the housing structure. An alignment collar is detached from the actuator assembly. The alignment collar has a first end constructed and arranged to be received in a bore of the cylinder head and a second end opposite the first end. The second end of the alignment collar is cooperable with an end of the actuator assembly. The detached alignment collar facilitates assembly of the electromagnetic actuator to a cylinder head. A method of securing an electromagnetic actuator to a cylinder head is also provided.

17 Claims, 2 Drawing Sheets

ELECTROMAGNETIC ACTUATOR WITH DETACHED LOWER COLLAR TO ALIGN WITH CYLINDER HEAD BORE

This patent application claims priority to copending U.S. Provisional Patent Application No. 60/069,144, filed Dec. 9, 1997.

BACKGROUND OF THE INVENTION

1. Field of the Invention

This invention relates to an electromagnetic actuator for a vehicle engine and, more particularly, to an electromagnetic actuator having a detached lower collar for aligning the actuator with a bore in the cylinder head of the vehicle's engine.

2. Description of Related Art

A conventional electromagnetic actuator for opening and closing a valve of an internal combustion engine generally includes "open" and "close" electromagnets which, when energized, produce an electromagnetic force on an armature. The armature is biased by a pair of identical springs arranged in parallel. The armature is coupled with an inlet or outlet gas exchange valve of the engine. The armature rests approximately half way between the open and close electromagnets when the springs are in equilibrium. When the armature is held by a magnetic force in either the closed or opened position (at rest against the open or close electromagnet), potential energy is stored by the springs. If the magnetic force is shut off with the armature in the opened position, the spring's potential energy will be converted to kinetic energy of the moving mass and cause the armature to move towards the close electromagnet. If friction is sufficiently low, the armature can then be caught in the closed position by applying current to the close electromagnet.

The conventional electromagnetic actuator has a one-piece lower housing 10 (FIG. 1) wherein an alignment collar 12 of the housing 10 is used to align the actuator to a cylinder head concentric with a valve which is to be actuated, as well as to house a hydraulic a valve lash adjuster (HVA). Thus, the outer and inner diameter of the collar 12 must be made very precisely via machining operations after the housing is roughly formed. The machining operations increase the cost of the actuator. Another purpose of the alignment collar of the housing is to provide a passage to transport oil from the oil feed in the cylinder head to the HVA.

The alignment collar 12 of the actuator housing 10, together with the HVA, is not integrated into the cylinder head because the cylinder head bore must be large enough to provide clearance for the lower valve spring. The HVA diameter is much smaller than the diameter of the lower valve spring, and is kept as small as possible to reduce the moving mass of the valve train.

In addition, the geometry of the conventional one-piece actuator housing 10 is not conducive to maintaining a stable geometry and, as such, the housing 10 tends to distort somewhat after manufacturing as internal stresses relax. The distortion problem is exacerbated by the core installation and coil over-molding process, at which time a molten resin is injected under very high-pressure into the interior of the housing (after the lamination core and coil have been installed).

An assembly problem is also associated with the conventional one-piece housing 10. The HVA must be installed into a bore in the alignment collar 12 of the actuator housing 10 prior to the installation of the actuator into the cylinder head. With the head in its upright position, the HVA will tend to fall out of the actuator during installation. Some retention structures have been proposed to alleviate this problem such as a providing additional parts or features to retain the HVA. However, these techniques are costly. Another proposal to retain the HVA during assembly is to coat the HVA with grease prior to installation in the alignment collar. However, this approach may attract dust during assembly.

Accordingly, there is a need to provide an electromagnetic actuator which eliminates the above-mentioned manufacturing and HVA installation problems.

SUMMARY OF THE INVENTION

An object of the present invention is to fulfill the need referred to above. In accordance with the principles of the present invention, this objective is obtained by providing an electromagnetic actuator for mounting to a cylinder head of an engine. The actuator includes an actuator assembly including housing structure and an armature. A pair of electromagnets are disposed in the housing structure. An alignment collar is detached from the actuator assembly. The alignment collar has a first end constructed and arranged to be received in a bore of the cylinder head and a second end opposite the first end. The second end of the alignment collar is cooperable with an end of the actuator assembly.

In accordance with another aspect of the invention, a method of securing an electromagnetic actuator to a cylinder head of an engine is provided. The actuator has an actuator assembly including housing structure and an armature. A pair of electromagnets are disposed in the housing structure. The actuator also has an alignment collar detached from the actuator assembly. The alignment collar has a first end constructed and arranged to be received in a bore of the cylinder head and a second end opposite the first end. The second end is cooperable with an end of the actuator assembly. The alignment collar has an axial bore therethrough. The method includes placing the first end of the alignment collar into the bore in the cylinder head such that the alignment collar does not fall completely into the bore. The hydraulic valve adjuster is placed into the axial bore of the alignment collar so that the hydraulic valve adjuster contacts a valve stem. The actuator assembly is then placed over the alignment collar and the actuator assembly is secured to the cylinder head.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 2:
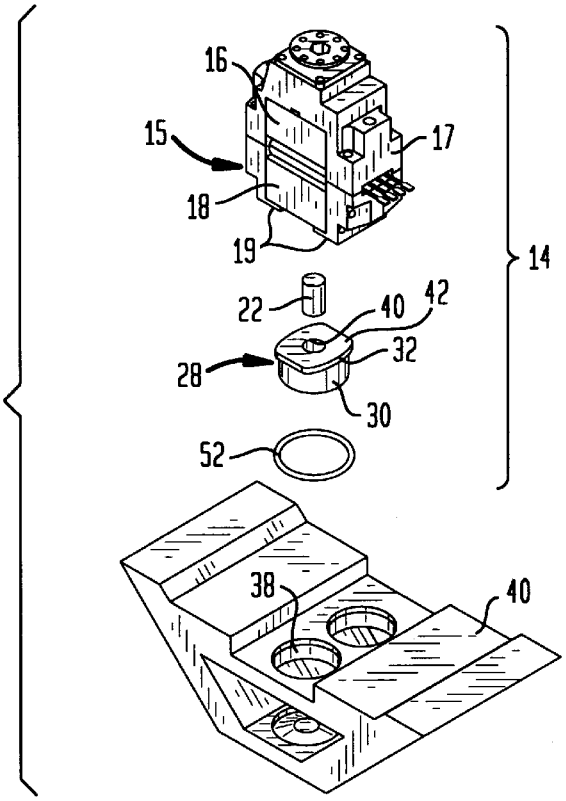
FIG. 2 is an exploded perspective view of an electromagnetic actuator having a detached alignment collar provided in accordance with the principles of the present invention, with the collar shown in position to be received within a bore in a cylinder head of an engine.
Figure 3:
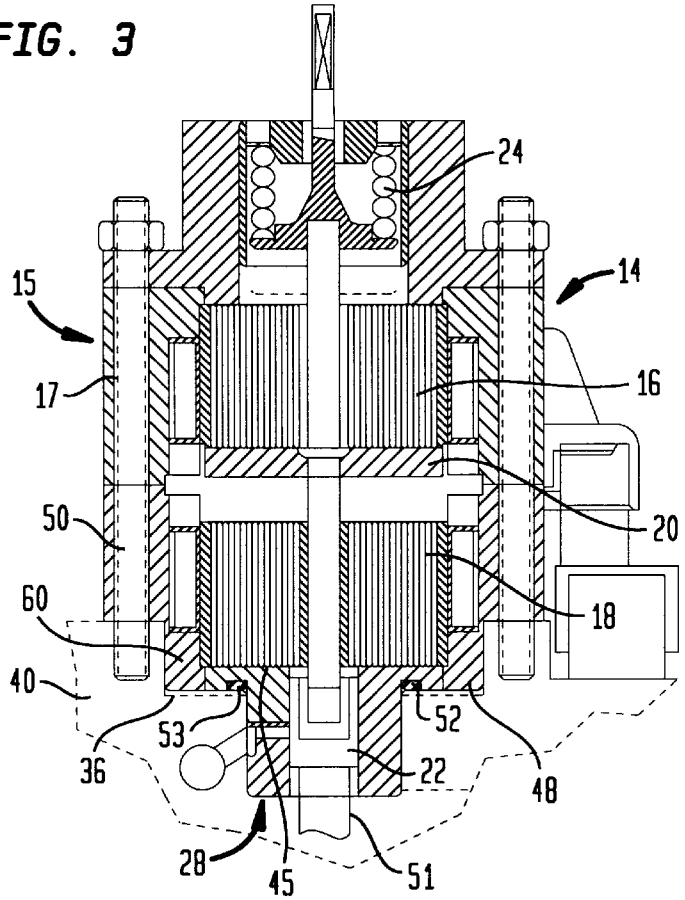
FIG. 3 is a sectional view of an electromagnetic actuator of FIG. 2 shown mounted in a bore of a cylinder head.

Referring to FIGS. 2 and 3, an electromagnetic actuator is shown, generally indicated 14, provided in accordance with the principles of the present invention. As best shown in FIG. 3, the electromagnetic actuator 14 includes an actuator assembly, generally indicated at 15, including housing structure 17 housing a first electromagnet 16 and a second electromagnet 18, which is disposed generally in opposing relation to the first electromagnet 16. The housing structure 17 may be of single part construction or may be composed of a multiple parts and, in the illustrated embodiment, includes inwardly projecting flanges 19 to receive the second electromagnet 18. The actuator assembly 15 includes an armature 20 which is connected to a stem 51 (FIG. 3) of a gas exchange valve (not shown) through a hydraulic valve adjuster 22. The armature 20 is disposed between the electromagnets 16 and 18 so as to be acted upon by an electromagnetic force created by the electromagnets. In a deenergized state of the electromagnets 16 and 18, the armature 20 is maintained in a position of rest generally between the two electromagnets 16 and 18 by opposing working return springs, one of which is shown at 24. The other working return spring (not shown) is associated with the cylinder valve (not shown) and acts on the armature 20.

Figure 4:
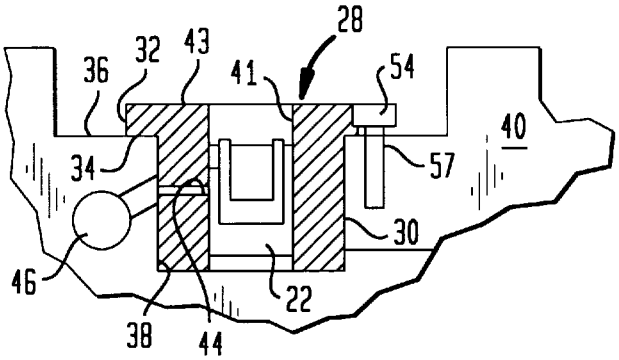
FIG. 4 a sectional view of an alignment collar of the electromagnetic actuator of the invention shown secured to a cylinder head by a fastener.

In accordance with the principles of the present invention and as best shown in FIG. 2, the electromagnetic actuator 14 also includes an alignment collar, generally indicated at 28, detached from the actuator assembly 15. The alignment collar 28 is preferably machined from bar stock. As shown in FIGS. 2 and 4, a first end 30 of the alignment collar 28 is generally cylindrical. A second end of the alignment collar 28 defines a flange 32 having a stop surface 34 (FIG. 4) constructed and arranged to contact a surface 36 adjacent bore 38 defined in a cylinder head 40 when the first end 30 of the alignment collar 28 is placed in the bore 38. Thus, the stop surface 34 of the flange 32 prevents the alignment collar 28 from falling completely into the bore 38 since the flange 32 is sized larger than the diameter of the first end 30 and thus, bore 38. Surface 43 of flange 32 is constructed and arranged to be cooperable with a lower portion 45 of the actuator assembly 15 when the actuator 14 is mounted to a cylinder head 40, as will be explained in more detail below. Surface 43 is a planar surface and may be of any desired shape, such as, circular, rectangular, etc., so long as it is cooperable with the actuator assembly 15.

Figure 1:
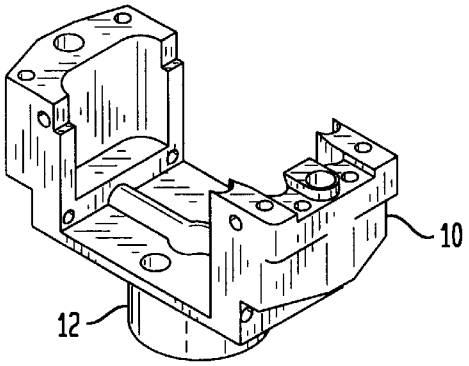
FIG. 1 (PRIOR ART)
FIG. 1 is a perspective view of a conventional electromagnetic housing having an integrally formed alignment collar.

With reference to FIGS. 1 and 4, the alignment collar 28 includes an axial bore 41 therethrough sized to receive the hydraulic valve adjuster 22 therein. Thus, once the alignment collar 28 is placed into the cylinder bore 38, the hydraulic valve adjuster 22 may be placed into bore 41 and will be prevented from falling through the collar by contacting the top of the valve stem 51 (FIG. 3).

Figure 5:
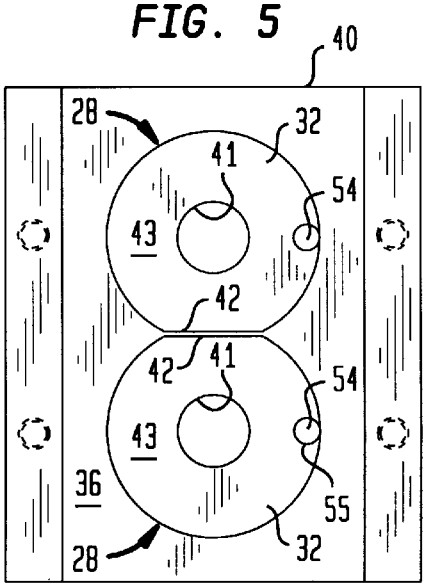
FIG. 5 is a plan view of a pair of alignment collars of the invention, each shown secured to a cylinder head via a fastener.

Further, as best shown in FIG. 5, the flange 32 of the alignment collar 28 includes at least one flat surface 42 formed perpendicular to the planar surface 43. The flat surface 42 facilitates clocking of an oil passage 44 of the alignment collar 28 with an oil feed line 46 in the cylinder head 40 (FIG. 4). With reference to FIG. 5, the alignment collars 28 for two adjacent valves can be installed in an associated collar bore with the flat surfaces 42 being adjacent, thus preventing the alignment collars 28 from rotating.

Installation of the actuator 14 over the alignment collar 28 and with respect to the cylinder head will prevent the alignment collar 28 from moving up out of the bore 38 in the cylinder head 40, but will not prevent vertical motion of the alignment collar 28 altogether. As best shown in FIG. 3, a small clearance should be maintained between surface 36 of the cylinder head 40 and the bottom surface 48 of the actuator 14 such that the actuator 14 contacts the cylinder head 40 directly below the mounting bolts 50 in order to support the mounting bolt loads. To prevent vertical motion of the alignment collar 28, an o-ring 52, disposed in groove 53, is used to take up the clearance. Thus, when the actuator 14 is mounted to the cylinder head 40, the o-ring is compressed between the surface defining the groove 53 and surface 36 of the cylinder head 40. Instead of providing an o-ring, a spring or other resilient member may be used to take-up the above mentioned clearance.

Alternatively, FIGS. 4 and 5 show the alignment collar 28 being locked down to the cylinder head 40 with at least one fastener 54. Thus, the flange 32 includes a fastener receiving bore 55 therein for receiving a treaded fastener 54. The cylinder head has a threaded bore 57 for engaging the fastener 54. The fastener(s) 54 will prevent vertical movement of the alignment collar 28 and prevents rotation thereof. A gap may then be created between the surface 43 of the flange 32 and the bottom surface 45 of the actuator assembly 15 so as not to load the alignment collar 28 when the actuator 14 is bolted to the cylinder head 40.

Figure 6:
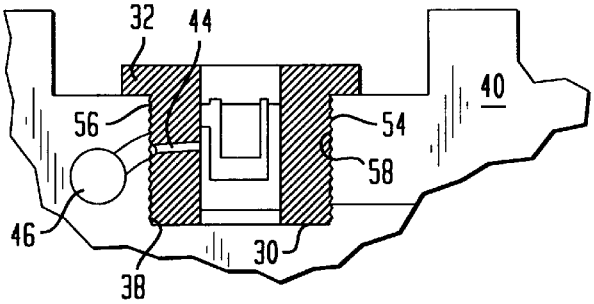
FIG. 6 is a sectional view of a second embodiment of an alignment collar of an electromagnetic actuator of the invention, shown secured to a cylinder head.

An alternate embodiment of the alignment collar 28' of the invention is shown in FIG. 6. The first end 30 of the alignment collar 28' includes threads 54 which mate with threads 56 of bore 38 in the cylinder head 40. As shown, the alignment collar 28 bottoms out at the flange 32 thereof. Alternatively, the alignment collar 28' may bottom out at the bottom of the bore 38 in the cylinder head 40. In addition, instead of having to align the oil passages by clocking as noted above, a circumferential groove 58 is provided in the first end 30 of the alignment collar 28' which permits communication between oil passage 44 and the axial bore 41.

Providing the detachable alignment collar 28 allows the lower housing 60 (FIG. 3) to compensate for variations in the length of the lamination stack of the actuator 14, while maintaining good contact between the ends of the housing 17 and the lamination stack. This results in a stronger assembly than the single piece housing with a pocket for the lamination stack to sit in (FIG. 1). In addition, the detachable alignment collar eases the installation of the hydraulic valve adjustor.

It has thus been seen that the objects of this invention have been fully and effectively accomplished. It will be realized, however, that the foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An electromagnetic actuator for mounting to a cylinder head of an engine, the actuator comprising:

an actuator assembly including a housing structure and an armature, and a pair of electromagnets disposed in said housing structure; and an alignment collar detached from said actuator assembly, said alignment collar having a first end constructed and arranged to be received in a bore of the cylinder head and a second end opposite said first end, said second end being cooperable with an end of said actuator assembly so as to align said actuator assembly with the bore.

2. The electromagnetic actuator according to claim 1, wherein said first end of said alignment collar is generally cylindrical, said second end of said alignment collar defining a flange having a stop surface, said stop surface being constructed and arranged prevent the alignment collar from falling completely into the bore of the cylinder head when the first end of the alignment collar is placed in the bore.

3. The electromagnetic actuator according to claim 1, wherein said alignment collar has a generally cylindrical axial bore therethrough constructed and arranged to receive a hydraulic valve adjuster of the electromagnetic actuator.

4. The electromagnetic actuator according to claim 1, wherein said second end of said alignment collar is in the form of a flange, a resilient member being associated with said flange such that said resilient member may be compressed between a surface of said flange and a surface of the cylinder head when the electromagnetic actuator is mounted to the cylinder head.

5. The electromagnetic actuator according to claim 4, wherein said flange defines an o-ring groove, said resilient member being an o-ring disposed in said groove such that said o-ring may be compressed between a surface of the groove and a surface of the cylinder head when the electromagnetic actuator is mounted to the cylinder head.

6. The electromagnetic actuator according to claim 2, wherein said flange is generally cylindrical having a planar surface which cooperates with said end of said actuator assembly, said flange including at least one flat surface substantially perpendicular to said planar surface.

7. The electromagnetic actuator according to claim 6, wherein said alignment collar includes an oil passage therein, said flat surface being associated with a location of the oil passage so as to permit alignment of the oil passage with an oil feed line in the cylinder head.

8. The electromagnetic actuator according to claim 2, wherein said flange includes a fastener receiving bore and a fastener is associated with said receiving bore, said fastener being constructed and arranged to be received by a threaded bore in the cylinder head such that said alignment collar may be securely fastened to the cylinder head.

9. An electromagnetic actuator for mounting to a cylinder head of an engine, the actuator comprising:

an actuator assembly including a housing structure and an armature, and a pair of electromagnets disposed in said housing structure; and an alignment collar separated from said actuator assembly, said alignment collar having a first end constructed and arranged to be received in a bore of the cylinder head and a second end opposite said first end, said second end being cooperable with an end of said actuator assembly, wherein said first end of said alignment collar is generally cylindrical and has external threads, said threads being constructed and arranged to engage threads in the cylinder head bore so as to secure the alignment collar to the cylinder head.

10. The electromagnetic actuator according to claim 9, wherein said alignment collar has an axial bore therethrough and a circumferential groove in said first end thereof, an oil passage in said alignment collar communicating said groove with said axial bore.

11. An electromagnetic actuator for mounting to a cylinder head of an engine, the actuator comprising:

an actuator assembly including a housing structure and an armature, and a pair of electromagnets disposed in said housing structure; and an alignment collar detached from said actuator assembly, said alignment collar having a first end having a diameter sized to be received in a bore of the cylinder head and a second end opposite said first end, said second end being in the form of a flange sized larger than the diameter of said first end and being cooperable with an end of said actuator assembly so as to align said actuator assembly with the bore.

12. A method of securing an electromagnetic actuator to a cylinder head of an engine, the actuator having an actuator assembly including a housing structure and an armature, and a pair of electromagnets disposed in said housing structure; the actuator also having an alignment collar detached from the actuator assembly, said alignment collar having a first end constructed and arranged to be received in a bore of the cylinder head and a second end opposite said first end, said second end being cooperable with an end of said actuator assembly, said alignment collar having an axial bore therethrough, the method including:

placing said first end of the alignment collar into the bore in the cylinder head, placing a hydraulic valve adjuster into the axial bore of the alignment collar so that the hydraulic valve adjuster contacts a valve stem, placing the actuator assembly over the alignment collar, and securing the actuator assembly to the cylinder head.

13. The method according to claim 12, wherein said actuator is secured to said cylinder head via a bolt in a manner as to not load said alignment collar.

14. The method according to claim 13, wherein said alignment collar includes a flange having an o-ring groove therein, an o-ring being disposed in said groove, said o-ring being compressed between a surface of said groove and a surface of said cylinder head wen said actuator assembly is secured to said cylinder head.

15. The method according to claim 12, wherein prior to placing said actuator assembly over said alignment collar, said alignment collar is attached to said cylinder head via at least one fastener.

16. The method according to claim 12, wherein said first end of said alignment collar is threaded into said bore of said cylinder head.

17. The method according to claim 12, wherein said step of placing the first end of the alignment collar into the bore of the cylinder head includes placing the alignment collar such that the alignment collar does not fall completely into the bore.

* * * * *